US005295860A

United States Patent [19]

Jozefczyk et al.

[11] Patent Number: 5,295,860

[45] Date of Patent: Mar. 22, 1994

[54] INTEGRAL BATTERY CABLE SOLENOID CONNECTOR

[75] Inventors: John Jozefczyk, Dearborn; Anthony L. Militello, Romulus, both of Mich.

[73] Assignee: Ford Motor Company, Dearborn, Mich.

[21] Appl. No.: 961,569

[22] Filed: Oct. 15, 1992

[51] Int. Cl.[5] ..... H01R 11/00; H01R 9/11

[52] U.S. Cl. ..... 439/503; 439/504; 439/623; 439/860

[58] Field of Search ..... 439/502, 503, 504, 505, 439/218, 222, 736, 907, 860, 623, 624, 685

[56] References Cited

U.S. PATENT DOCUMENTS

| | | | |
|---|---|---|---|
| 3,202,959 | 8/1965 | Keller | 439/685 |
| 3,407,382 | 10/1968 | Haegert . | |
| 3,783,439 | 1/1974 | Valentino . | |
| 4,063,794 | 12/1977 | Dittmann . | |
| 4,126,367 | 11/1978 | Miller . | |
| 4,336,975 | 6/1982 | Casteel | 439/503 |
| 4,354,726 | 10/1982 | Kato et al. . | |
| 4,556,275 | 12/1985 | Hamsher, Jr. | 439/736 |
| 4,643,511 | 2/1987 | Gawlik et al. . | |
| 5,195,912 | 3/1993 | Lintott | 439/685 |

FOREIGN PATENT DOCUMENTS

| | | | |
|---|---|---|---|
| 94270 | 4/1990 | Japan | 439/502 |
| 112183 | 4/1990 | Japan | 439/502 |
| 89/02663 | 3/1989 | World Int. Prop. O. | 439/685 |

*Primary Examiner*—Mark Rosenbaum
*Assistant Examiner*—David P. Bryant
*Attorney, Agent, or Firm*—Damian Porcari; Roger L. May

[57] ABSTRACT

The present invention provides a unique connector adapted to connect the first ends of two different conductors to a standard solenoid cap of an automobile. The second ends of the two different conductors are adapted to be connected to the battery of an automobile. The connector assembly is comprised of a connector assembly having a housing member that is adapted to accept and retain the first ends of the first and second conductors and connect them to, respectively, an eyelet and a female spade terminal. The connector assembly serves to orient the first and second conductors and the eyelet and female spade terminal attached thereto in such a manner that securing the eyelet to a screw stud of the standard solenoid cap also serves to simultaneously engage the female spade terminal with a male spade terminal of the standard solenoid cap.

11 Claims, 3 Drawing Sheets 22
30b
92
88
36
28b
14b
20
30b
86
90

INTEGRAL BATTERY CABLE SOLENOID CONNECTOR

FIELD OF THE INVENTION

This invention relates to a connector adapted to facilitate in the electrical connection between the solenoid and battery of a motor vehicle. More particularly, the invention relates to a connector assembly for retaining the position and orientation of the power conductors, extending from the battery, in a manner that enables retention and virtually simultaneous connection thereof to a standard solenoid cap.

BACKGROUND OF THE INVENTION

In a conventional motor vehicle, the solenoid is connected to a battery via a power cable (first conductor) and an "S" terminal wire (second conductor). The power cable terminates in an eyelet connector which receives a screw stud of the solenoid. A nut secures the eyelet/stud electrical connection. The solenoid also includes a male spade terminal adapted to engage and mate with a female spade terminal, attached to the "S" terminal wire. The screw stud and male spade terminal extend in a substantially parallel fashion from the end cap of the solenoid.

SUMMARY OF THE INVENTION

According to the present invention, a connector assembly is adapted to house a portion of a first conductor, for instance, the power cable connecting the battery to the solenoid, and a segment of a second conductor, for instance, the "S" terminal wire connecting the battery to the solenoid. The first and second conductors terminate in a first connector and a second connector, respectively, that are electrically connectable to a first terminal and a second terminal, respectively, of a solenoid. The connector assembly is comprised of housing means for retaining a predetermined displacement and orientation between the portion and the segment. The housing means allows for simultaneous connection of the first connector and the second connector to the first terminal and the second terminal, respectively. From the summary, drawings, and descriptions below, it will be readily understood by those of ordinary skill in the art how the connector of the invention provides various advantages and constitutes a significant advance in the art.

In its preferred form, the connector is comprised of a housing member, a first conductor, and a second conductor. The housing member has a main body and an extension arm extending from the main body. The main body and the extension arm are arranged to form a generally "L" shaped housing member. The main body has a first aperture. The main body and the extension arm have a second aperture. The second aperture houses a female spade terminal. The first conductor has a portion retained in the main body. The portion is connected to an eyelet that is adapted to fit around the screw stud of the solenoid. The second conductor has a segment retained in the main body and the extension arm. The segment is in electrical contact with the female spade terminal housed within the second aperture. The female spade terminal is adapted to engage a male spade terminal of the solenoid. The eyelet and the female spade terminal are oriented with respect to each other such that fitting the eyelet around the screw stud of the solenoid and securing it thereto by tightening a nut onto the screw stud will cause the female spade terminal to engage the male spade terminal of the solenoid.

Accordingly, the preferred form of the present invention is advantageous over prior devices in that it allows for simultaneous engagement of both the first and second conductors to the solenoid by fitting the eyelet over a screw stud of the solenoid and securing it with a nut. Thus, it can be seen that two separate connections, namely the screw-on type connection of the eyelet and the push-pull type connection of the male and female spade terminals are no longer necessary. The additional features and advantages of the invention will be further understood from the following detailed description of the preferred embodiment.

BRIEF DESCRIPTION OF THE DRAWINGS

The present invention is shown for purposes of illustration, but not of limitation, in the accompanying drawings in which like numbers refer to like parts throughout and in which.

DETAILED DESCRIPTION OF THE PREFERRED EMBODIMENT

Figure 1:
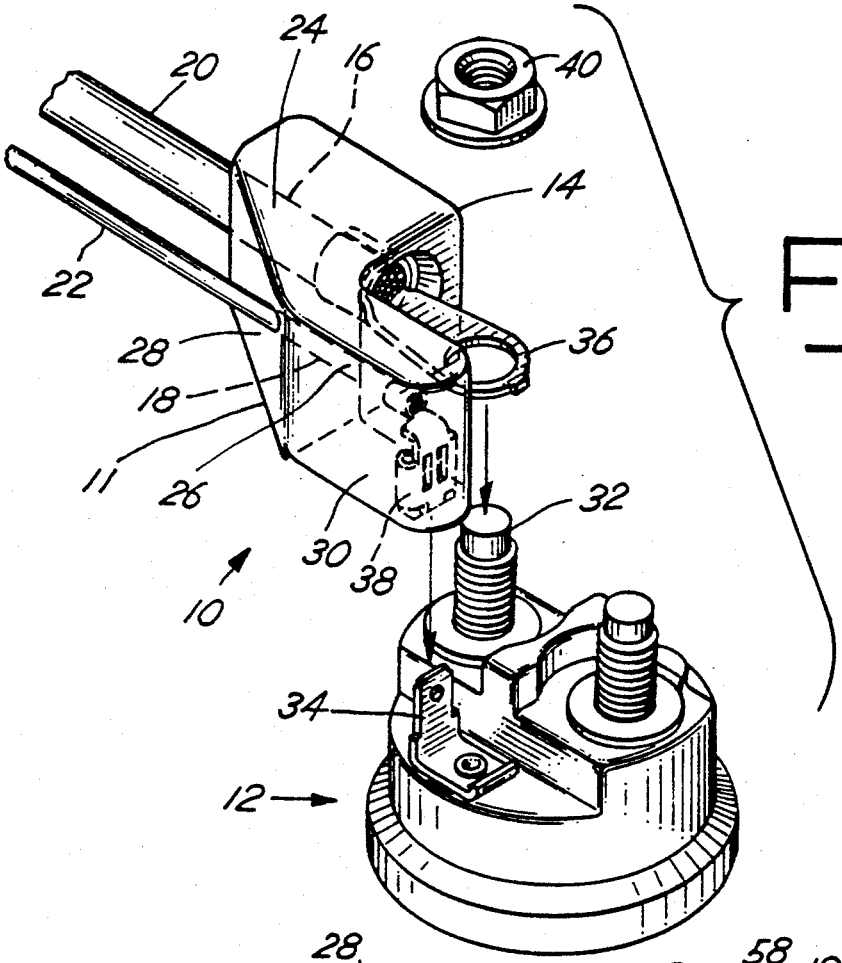
FIG. 1 is an exploded perspective view of a first embodiment of the connector assembly and a standard solenoid cap.
Figure 2:
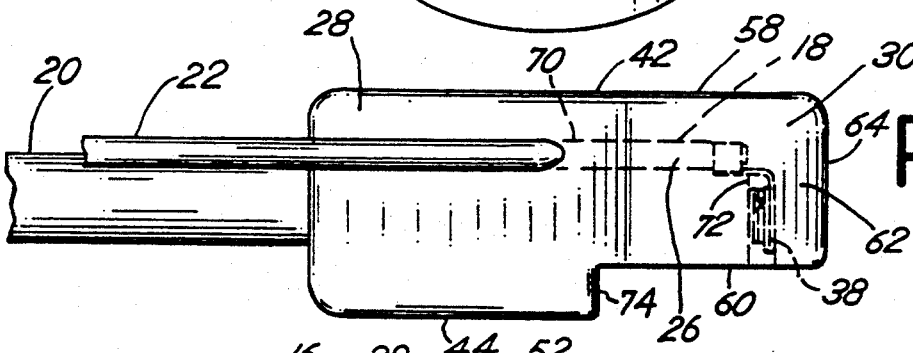
FIG. 2 is a side view of the first embodiment of the connector assembly.
Figure 3:
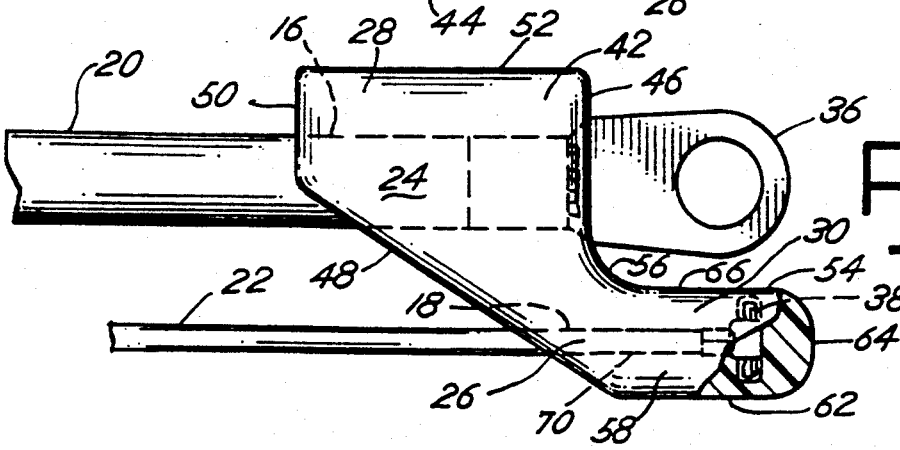
FIG. 3 is a partial top cross-sectional view of the first embodiment of the connector assembly.

The detailed description of FIGS. 1 through 3 describe a first embodiment of the present invention. The detailed description of FIGS. 4 and 5 describe a second embodiment of the present invention. The detailed description of FIG. 6 describes a third embodiment of the present invention. Alternative embodiments of the present invention will be apparent to those skilled in the art in view of the present disclosure.

FIG. 1 shows a first embodiment of a connector 10 adapted to be connected a standard solenoid cap 12. The connector 10 is comprised of a connector assembly 11 having a housing member 14. The housing member 14 has a first means for conductor retention, or first aperture, 16 (shown in phantom) and a second means for conductor retention, or second aperture, 18 (shown in phantom). The connector assembly 11 is adapted to house a first conductor 20 and a second conductor 22. More specifically, the connector assembly 11 is adapted to house a portion 24 of the first conductor 20 and a segment 26 of the second conductor 22. The housing member, or housing means for retaining, 14, serves to retain a predetermined displacement and orientation between the portion 24 and the segment 26. The first conductor 20 and the second conductor 22 contact the first aperture 16 and the second aperture 18, respectively, of the housing member 14 when the connector 10 is complete The portion 24 of the first conductor 20 is retained in the first aperture 16. The segment 26 of the second conductor 22 is retained in the second aperture 18. The housing member 14 has a main body 28 and an extension arm 30 that extends from the main body 28. The main body 28 and the extension arm 30 are arranged to form a generally "L" shaped housing member. The first aperture 16 is contained within the main body 28 whereas the second aperture 18 is contained within both the main body 28 and the extension arm 30.

Again referring to FIG. 1, the standard solenoid cap 12 has a first terminal, preferably a screw stud, 32 and a second terminal, preferably a male spade terminal, 34. The first terminal 32 is adapted to receive a first connector, preferably an eyelet, 36, that serves to terminate the first conductor 20. The second terminal 34 is adapted to engage a second connector, preferably a female spade terminal, 38, that serves to terminate the second conductor 22. Also shown is an engagement means for attaching, preferably a nut, 40 that is used to secure the eyelet 36, the eyelet 36 being attached to the first conductor 20, to the standard solenoid cap 12. The engagement means 40 and the housing member 14 cooperate to define a securing means 41 for engaging the second connector 38 to the second terminal 34. Essentially, the first conductor 20 is electrically coupled to the screw stud 32 of the standard solenoid cap 12 via the eyelet 36. Further, the second conductor 22 is electrically coupled to the male spade terminal 34 of the standard solenoid cap 12 via the female spade terminal 38. The orientation of the female spade terminal 38 with respect to the eyelet 36 is such that the eyelet 36 will not fit around the screw stud 32 unless the female spade terminal 38 is in a position to engage the male spade terminal 34 of the standard solenoid cap 12. The housing member 14 assures proper orientation of the female spade terminal 38 with respect to the eyelet 36 via its spacing of the first conductor 20 and the second conductor 22 within the housing member 14. Thus, as will be apparent to those of skill in the art, securing the eyelet 36 to the screw stud 32 also serves to force a female spade terminal 38 onto the male spade terminal 34 of the standard solenoid cap 12 due to the orientation between the female spade terminal 38 and eyelet 36. Therefore, the housing member 14 allows for simultaneous connection of the first connector, or eyelet, 36, and the second connector, or female spade terminal, 38, to the first terminal 32 and the second terminal 34, respectively, due to the predetermined displacement and orientation between the portion 24 and the segment 26.

Referring to FIGS. 2 and 3, the main body 28 of the housing member 14 is generally trapezoidal. Thus, the main body 28 has six generally planar surfaces, namely top surface 42, bottom surface 44, and side surfaces 46, 48, 50, and 52. The extension arm 30 extends from side surface 46. As shown, the extension arm 30 has a generally rectangular portion 54 and a connection portion 56 that serves to fixedly attach the extension arm 30 to the main body 28.

Referring again to FIGS. 2 and 3, the generally rectangular portion 54 of the extension arm 30 has six generally planar surfaces, namely top surface 58, bottom surface 60, and side surfaces 62, 64, 66, and 68 (68 not shown). Also, the first aperture 16 is generally cylindrically shaped. The second aperture 18 has a first portion 70 and a second portion 72 arranged in a generally "L" shaped configuration. The first portion 70 is generally parallel to the first aperture 16. The second portion 72 is generally perpendicular to the first aperture 16. Thus, since the first and second apertures, 16 and 18, serve to retain the portion 24 and the segment 26 of the first and second conductors, 20 and 22, respectively, the portion 24 is generally cylindrically shaped and the segment 26 is generally "L" shaped.

FIG. 2 shows a notched portion 74 of the housing member 14. Thus, the bottom surface 44 of the main body 28 is not coplanar with a bottom surface 60 of the extension arm 30. Rather, the bottom surfaces, 44 and 60, define generally parallel planes. The notched portion 74 of the housing member 14 allows the connector 10 to more easily connect to the standard solenoid cap 12.

FIG. 3 also shows a portion 24 of the first conductor 20 retained in the first aperture 16. Also shown is a segment 26 of the second conductor 22 retained in the second aperture 18 of housing member 14. The eyelet 36 is attached to the portion 24 of the first conductor 20. The eyelet 36 is adapted to fit around the screw stud 32 of the standard solenoid cap 12. The second portion 72 of the second aperture 18 houses the female spade terminal 38 that is connected to the segment 26 of the second conductor 22.

Figure 4:
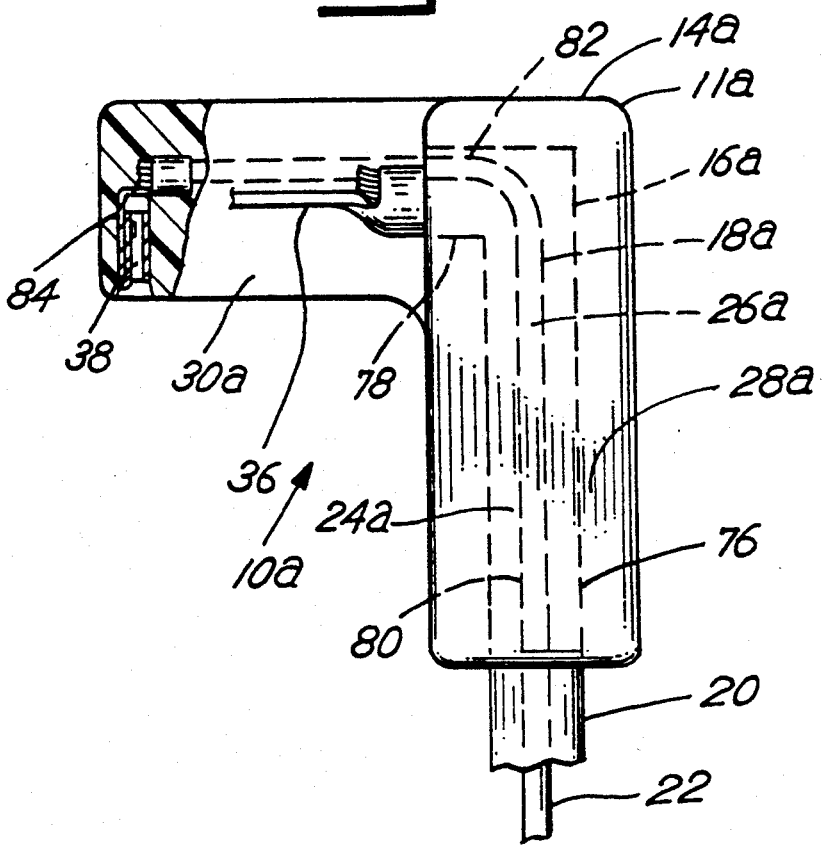
FIG. 4 is a partial side cross-sectional view of the second embodiment of the connector assembly.
Figure 5:
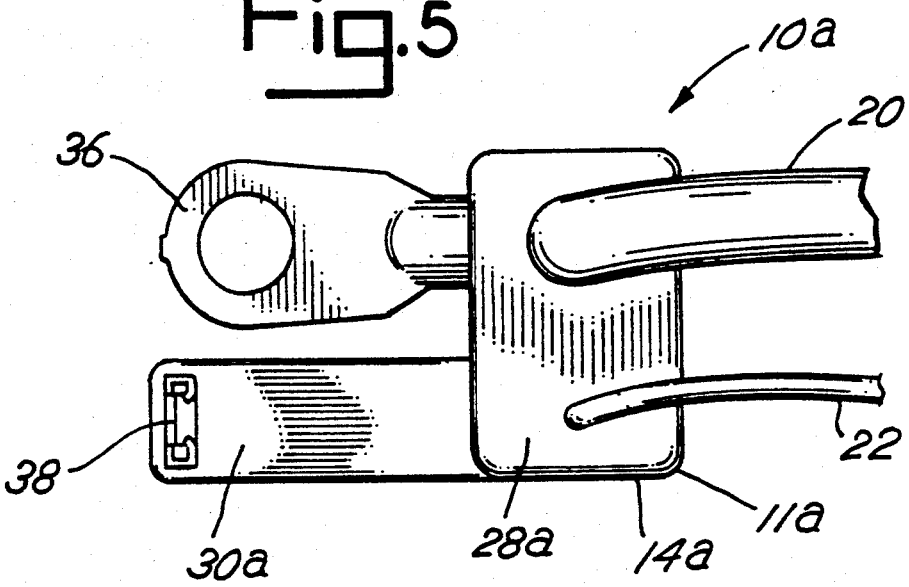
FIG. 5 is a bottom view of the second embodiment of the connector assembly.

FIGS. 4 and 5 show a perspective view and bottom view, respectively, of a second embodiment of the invention. Reference numerals used previously will use the suffix "a" to denote similar but not identical structure. Previously used reference numerals will be used to denote identical structure.

FIG. 4 shows a connector 10*a* that is adapted to be electrically connected to a standard solenoid cap 12. The connector 10*a* has a connector assembly 11*a* that has a housing member 14*a*, the housing member 14*a* having a first aperture 16*a* (shown in phantom) and a second aperture 18*a* (shown in phantom). The connector 10*a* shown in FIG. 4 depicts the first conductor 20, the second conductor 22, a portion 24*a* of the first conductor 20, a segment 26*a* of the second conductor 22, a main body 28*a*, and an extension arm 30*a*. Preferably, the main body 28*a* and the extension arm 30*a* are fixedly attached to each other and are arranged in a generally "L" shaped configuration.

Referring to FIGS. 4 and 5, eyelet 36 is fitted around screw stud 32 (see FIG. 1) and nut 40 (see FIG. 1) is rotated onto screw stud 32 securing eyelet 36 to the standard solenoid cap 12. This also serves to secure the female spade terminal 38 to male spade terminal 34 (see FIG. 1) of standard solenoid cap 12 due to the orientation of the eyelet 36 with respect to the female spade terminal 38, as explained with reference to the first embodiment of the invention.

FIG. 4 shows first and second portions, 76 and 78, respectively, of the first aperture 16 (all in phantom). Also shown are first, second, and third portions, 80, 82, and 84, respectively, of the second aperture 18*a* (all in phantom). The first portion 76 of the first aperture 16*a* is generally parallel to the first and third portions, 80 and 84, respectively, of the second aperture 18*a*. Further, the first portion 76 of the first aperture 16*a* is generally perpendicular to the second portion 78 of the first aperture 16*a* and the second portion 82 of the second aperture 18*a*, the second portions, 78 and 82, respectively, of the first aperture 16*a* and the second aperture 18*a* being generally parallel to each other. It will be clear to those of skill in the art that FIG. 4 shows the generally "J" shaped configuration of the second aperture 18*a* and the generally "L" shaped configuration of the first aperture 16*a*. Thus, since the first and second apertures, 16*a* and 18*a*, serve to retain the portion 24*a* and the segment 26*a* of the first and second conductors, 20 and 22, respectively, the portion 24*a* is generally "L" shaped and the segment 26*a* is generally "J" shaped.

Figure 6:
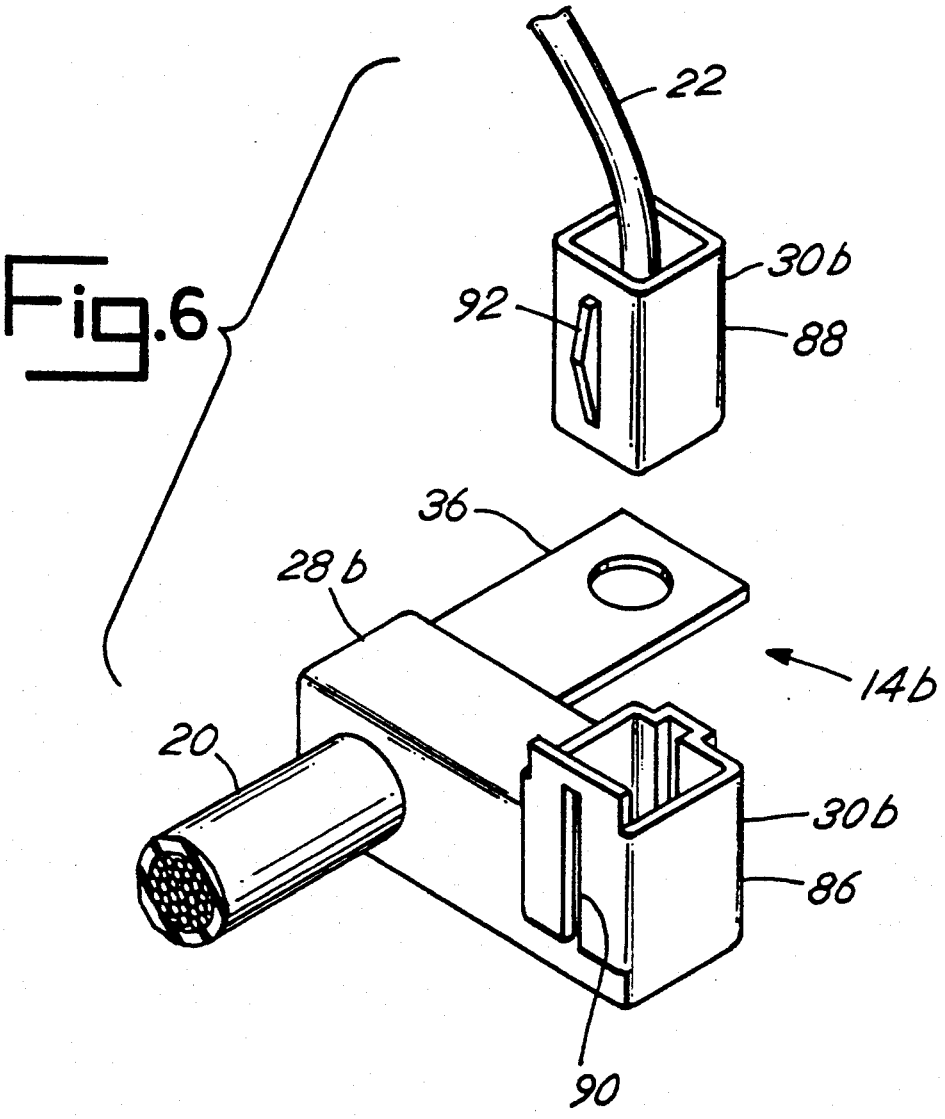
FIG. 6 is an exploded perspective view of a third embodiment of the connector assembly adapted to be connected to a standard solenoid cap.

FIG. 6 shows an exploded perspective view of a third embodiment of the invention. Reference numerals used previously will use the suffix "b" to denote similar but not identical structure. Previously used reference numerals will be used to denote identical structure.

FIG. 6 shows a housing member 14*b* that is comprised of a main body 28*b* and an extension arm 30*b*. The extension arm 30*b* is comprised of a first mating terminal 86 and a second mating terminal 88. The first mating terminal 86 extends from and is attached to the main body 28*b*. The second mating terminal 88 is attached to the segment 26*b* (not shown) of the second conductor 22. The second mating terminal 88 can be attached to the first mating terminal 86 and thus, cooperates with the first mating terminal 86 to connect the first conductor 20 and the second conductor 22 to the standard solenoid cap 12 (not shown). The first mating terminal has a slot 90 that is adapted to accept a locking tab 92 of the second mating terminal 88 when the first mating terminal 86 and the second mating terminal 88 are joined. The locking tab 92 cooperates with the slot 90 to secure the first mating terminal 86 to the second mating terminal 88. The first mating terminal 86 and the second mating terminal 88 are keyed with respect to each other so that the only orientation in which they can be joined requires the slot 90 to cooperate with the locking tab 92. Thus, provided that the first mating terminal 86 is secured to the second mating terminal 88, the embodiment of the invention shown in FIG. 6 permits simultaneous connection of the first connector 36 and the second connector 38 (not shown) to the first terminal 32 (not shown) and the second terminal 34 (not shown), respectively, of the standard solenoid cap 12 due to the predetermined displacement and orientation between the portion 24*b* (not shown) and the segment 26*b*.

The invention has been described in detail with particular reference to two embodiments thereof. However, it will be understood that variations and modifications, including, for example, but not limited to, (1) the change in shape of the housing member 14/14*a* (which may, in turn, change the shape of the portion and segment of the first and second conductors); (2) the use of any type or combination of types of electrical connector(s) known in the art to serve as the first and second connectors and the use of the reciprocating (i.e., mating) electrical parts also known in the art to serve as the first and second terminals; and (3) the use of different types of securing means for the different types of connectors and terminals that may be used can be effected within the spirit and scope of the invention as described hereinabove and as defined in the appended claims.

We claim:

1. A connector unit in combination with a portion of a first conductor and a segment of a second conductor, the first and second conductors terminating in a first connector and a second connector, respectively, that are electrically connectable to a first terminal and a second terminal, respectively, of a solenoid, said connector unit comprising:

a generally L-shaped housing defined by a main body and an extension arm extending from the main body, the main body and the extension arm at least partially retaining the portion and segment, respectively for fixedly retaining a predetermined displacement and orientation between the portion and the segment and between the first connector and second connector, whereby simultaneous connection of the first connector and the second connector to the first terminal and the second terminal, respectively, is achieved due to the predetermined displacement and orientation whenever the first connector is applied to the first terminal.

2. The connector unit of claim 1 wherein the main body and the extension arm are integrally formed.

3. The connector unit of claim 1 wherein the portion is generally "L" shaped and wherein the segment is generally "J" shaped and retained by the main body and the extension arm.

4. The connector unit of claim 1 wherein the extension arm further comprises:

(a) a first mating terminal extending from the main body;

(b) a second mating terminal that cooperates with the first mating terminal, the second mating terminal being attached to the segment of the second conductor.

5. A connector unit in combination with a portion of a first conductor and a segment of a second conductor, the first and second conductors terminating in a first connector and a second connector, respectively, that are electrically connectable to a first terminal and a second terminal, respectively, of a solenoid, said connector unit comprising:

a housing, defined by a main body and an extension arm extending from the main body, the main body and the extension arm being arranged so that the housing is generally "L" shaped, for fixedly retaining a predetermined displacement and orientation between the portion and the segment and between the first connector and the second connector, the portion extending through and retained by the main body and the segment extending through and retained by the extension arm, whereby simultaneous connection of the first connector and the second connector to the first terminal and the second terminal, respectively, is achieved due to the predetermined displacement and orientation whenever the first connector is applied to the first terminal.

6. The connector unit of claim 5 wherein the first connector is an eyelet and the second connector is a female spade terminal.

7. A connector assembly that is electrically connectable to a solenoid having a first terminal and a second terminal, the connector assembly comprising:

(a) a first conductor terminating in a first connector adapted to electrically engage the first terminal;

(b) a second conductor terminating in a second connector adapted to electrically engage the second terminal; and (c) housing means for retaining a portion of the first conductor and a segment of the second conductor resulting in a predetermined displacement and orientation between the first connector and the second connector, the predetermined displacement and orientation between the first and second connectors defining a means for simultaneously connecting the first and second connectors to the first and second terminals, respectively, of the solenoid, the housing means being further comprised of:

(1) a main body that retains the portion;

(2) an extension arm extending from the main body, the main body and the extension arm being arranged so that the housing means is generally "L" shaped, the extension arm having a first mating terminal extending from the main body, the first mating terminal having a slot, the extension arm also having a second mating terminal that cooperates with the first mating terminal, the second mating terminal being attached to the segment of the second conductor, the second mating terminal having a locking tab that cooperates with the slot;

whereby when the first mating terminal is joined with the second mating terminal, the locking tab cooperates with the slot, securing the second mating terminal to the first mating terminal.

8. A connector assembly adapted to be electrically connected to a standard solenoid cap, the connector assembly comprising:

(a) a housing member having a main body and an extension arm extending from the main body, the main body and the extension arm being arranged to form a generally "L" shaped housing member;

(b) a first conductor having a portion retained in the main body, the portion being connected to a first connector that is adapted to engage a first terminal of the standard solenoid cap;

(c) a second conductor having a segment retained in the extension arm, the segment being in electrical contact with a second connector housed in the housing member, the second connector being adapted to engage a second terminal of the standard solenoid cap; and (d) engagement means for attaching the first connector to the first terminal;

whereby the housing member displaces and orients the first connector and the second connector with respect to each other in a manner wherein coupling the first connector to the first terminal and attaching the engagement means to the first terminal to secure the first connector thereto also serves to engage the second connector to the second terminal.

9. The connector assembly of claim 8 wherein the first connector is an eyelet, the second connector is a female spade terminal, and the engagement means is a nut.

10. The connector assembly of claim 8 wherein the portion is generally "L" shaped and wherein the segment is generally "J" shaped.

11. The connector assembly of claim 8 wherein the portion is generally cylindrically shaped and wherein the segment is generally "L" shaped.

* * * * *